US005660030A

United States Patent [19]

Auerbach et al.

[11] Patent Number: 5,660,030

[45] Date of Patent: Aug. 26, 1997

[54] HIGH SPEED ENVELOPE INSERTING STATION

[75] Inventors: David R. Auerbach, Redding; George Branecky, Bethel, both of Conn.

[73] Assignee: Pitney Bowes Inc., Stamford, Conn.

[21] Appl. No.: 552,766

[22] Filed: Nov. 3, 1995

[51] Int. Cl.[6] ..... B65B 43/26

[52] U.S. Cl. ..... 53/569; 53/284.3; 53/381.5

[58] Field of Search ..... 53/284.3, 569, 53/381.5, 381.6, 381.7

[56] References Cited

U.S. PATENT DOCUMENTS

| | | | |
|---|---|---|---|
| 2,839,880 | 6/1958 | Boughton | 53/569 |
| 4,337,609 | 7/1982 | Foster et al. | 53/569 |
| 4,649,691 | 3/1987 | Buckholz | 53/284.3 X |
| 4,798,040 | 1/1989 | Haas et al. | 53/569 X |
| 4,852,334 | 8/1989 | Auerbach | 53/569 |
| 4,921,388 | 5/1990 | Nelson | 53/569 X |
| 5,168,689 | 12/1992 | Macelis | 53/569 |
| 5,191,751 | 3/1993 | Marzullo et al. | 53/569 |
| 5,251,425 | 10/1993 | Kern | 53/569 X |
| 5,255,498 | 10/1993 | Hotchkiss et al. | 53/569 |
| 5,447,015 | 9/1995 | Belec et al. | 53/569 X |

*Primary Examiner*—Daniel Moon

*Attorney, Agent, or Firm*—Lawrence E. Sklar; David E. Pitchenik; Melvin J. Scolnick

[57] ABSTRACT

Apparatus for inserting sheet materials into an envelope. The apparatus includes: a deck for supporting an envelope and sheet material to be inserted into the envelope, the deck having an upstream and a downstream end; an inserting station located at the downstream end of the deck; a retractable stop extending through the deck at the inserting station; an upstream and a downstream pulley located substantially below the deck at the inserting station, the upstream pulley located upstream of the stop and the downstream pulley located downstream of the stop; a belt trained over the upstream and downstream pulleys for continuously urging the envelope against the stop; a device to continuously drive the belt; a device for feeding envelopes onto the deck against the stop; and a device for inserting the sheet material into the envelope when the envelope is resting against the stop.

5 Claims, 4 Drawing Sheets

HIGH SPEED ENVELOPE INSERTING STATION

BACKGROUND OF THE INVENTION

The instant invention relates to envelope inserting apparatus, and more particularly to apparatus for guiding the envelope to the inserting station.

Envelope stuffing machines, for example of the type shown in U.S. Pat. No. 2,736,999 issued Mar. 6, 1956 to F. J. Rouan, et al., U.S. Pat. No. 2,914,895 issued Dec. 1, 1959 to S. W. Martin, U.S. Pat. No. 4,077,181 issued Mar. 7, 1978 to L. K. Asher, et al., and U.S. Pat. No. 4,169,341 issued Oct. 2, 1979 to F. T. Roetter, et al., all of which patents are assigned to the assignee of the present invention, generally include: structure for delivering an envelope, with its address panel oriented upwardly and its flap opened, to a registration gate at an enclosure inserting station; structure for timely opening the delivered envelope, including a plurality of fingers known in the art as stripper fingers, which are insertable into the throat of the envelope for opening the same; and structure for inserting an enclosure into the opened envelope. More particularly, the envelope opening structure of these devices includes a plate which acts as a ledge upon which the flap of the envelope is located when it is delivered to the inserting station.

In U.S. Pat. No. 4,337,609 issued Jul. 6, 1982 to D. H. Foster, et al. and assigned to the assignee of the present invention, there is shown an envelope stuffing apparatus which includes an enclosure ram, a pair of outfeed push rollers and stripper fingers. The ram comprises a reciprocal ram plate having a depending portion which engages the enclosures. On the forward stroke of the ram plate, the plate carries therewith the enclosures into the throat of the opened envelope. As is well known in the art, the ram plate also moves the stuffed envelope downstream into feeding engagement with the outfeed rollers. Accordingly, the ram and outfeed rollers cooperate with each other for removing stuffed envelopes from the insert station.

The ram envelope stuffing apparatus of the above type has been successfully employed for many years. Although working well, there is a limitation on the throughput at the insertion station because of the reciprocating action of the ram plate. Typically, the ram insertion station operates well at a rate less than 6000 cycles (or envelopes per hour) for #10 (4 inch by 9 inch) envelopes. The rate of operation varies for different sized envelopes.

Improvements have been made recently in the throughput of the upstream modules of the inserter machine. However, the insert station employing the ram plate cannot take advantage of the improvements to the throughput of the upstream modules. This is, in part, due to the physical constraints associated with the ram mechanism, and, in part, to the motion lo inherent in the operating ram. Attempts at increasing the throughput of the ram type insert station has resulted in severe vibrations as the mass of the ram reciprocates at higher speeds. Such vibrations induce severe life shortage of the parts in the insert station. In addition, the reliability of the insert station decreases significantly at the higher speeds.

Accordingly, U.S. Pat. No. 5,255,498, issued Oct. 26, 1993 to the assignee of the instant invention, provided pusher fingers to replace the ram mechanism. The pusher fingers allow the insert station throughput speed to be increased without the problem inherent with increasing the speed of the ram mechanism. The '498 patent also provided a replacement for the typical fingers or envelope throat openers. The replacement comprises a throat opener having a side guide for preventing the enclosures from crashing into the side of the envelope.

The approach of the '498 patent did in fact allow higher operating speeds. However, such speeds had a limit, so that the inserting process was limited to about 10,000 cycles (or envelopes) per hour. Increasing the speed of the insertion process above 10,000 cycles per hour resulted in envelopes bouncing back from the envelope stops and not being in proper position for insertion, thereby resulting in jams.

Thus, the instant invention provides apparatus which prevents the envelope from bouncing back from the envelope stops at the insert station, thereby allowing the entire insertion process to be run at speeds of 13,000 cycles per hour and higher.

SUMMARY OF THE INVENTION

Accordingly, the instant invention provides apparatus for inserting sheet materials into an envelope. The apparatus includes: a deck for supporting an envelope and sheet material to be inserted into the envelope, the deck having an upstream and a downstream end; an inserting station located at the downstream end of the deck; a retractable stop extending through the deck at the inserting station; an upstream and a downstream pulley located substantially below the deck at the inserting station, the upstream pulley located upstream of the stop and the downstream pulley located downstream of the stop; a belt trained over the upstream and downstream pulleys for continuously urging the envelope against the stop; a device to continuously drive the belt; a device for feeding envelopes onto the deck against the stop; and a device for inserting the sheet material into the envelope when the envelope is resting against the stop.

DETAILED DESCRIPTION OF THE PREFERRED EMBODIMENT

Figure 1:
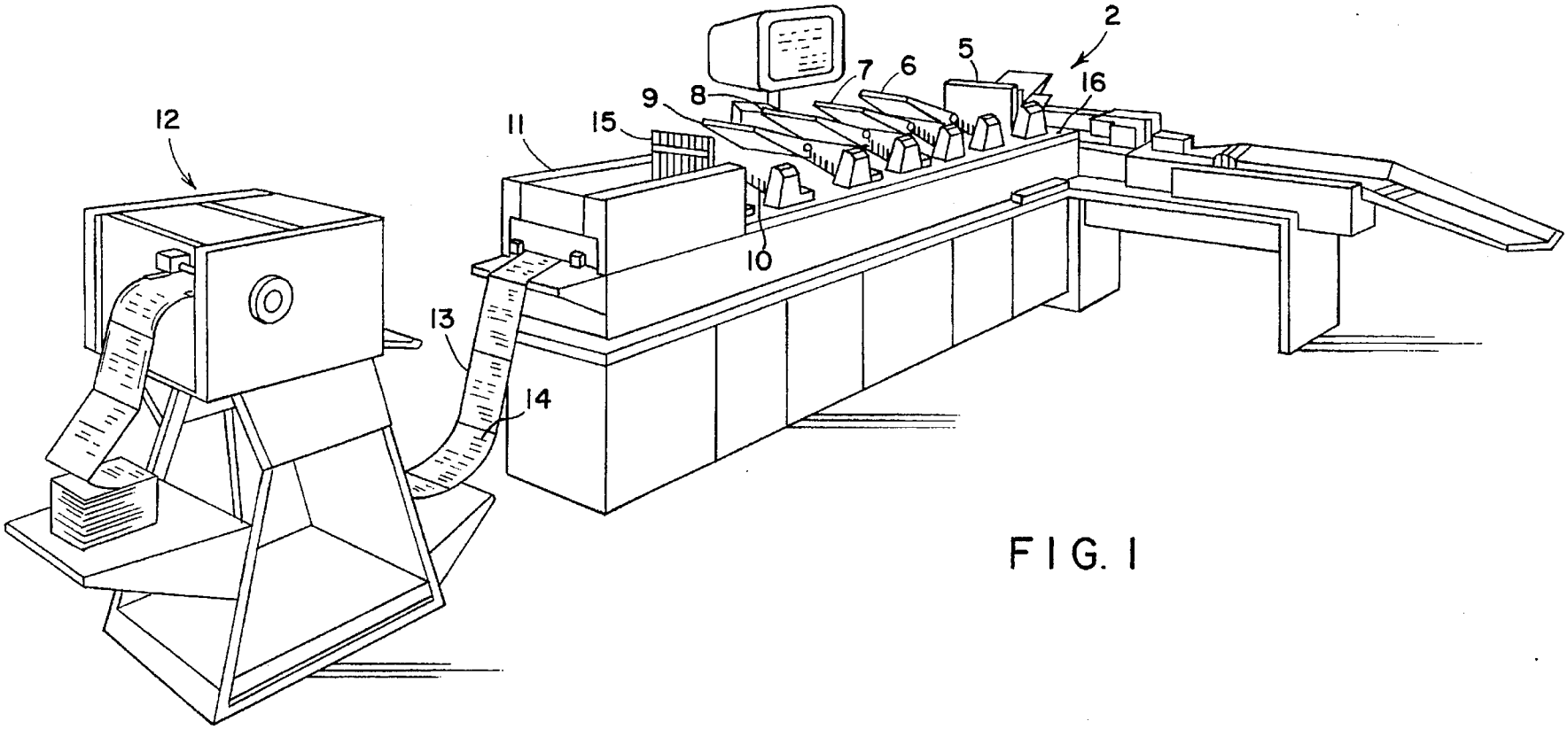
FIG. 1 is a console inserter machine in which the instant invention may be used.

In describing the instant invention, reference is made to the drawings, wherein there is seen FIG. 1 a console inserter 2 which includes a plurality of serially arranged modules including envelope feeder/insert station 5 and six document feeder stations, including five feeder stations designated 6, 7, 8, 9 and 10 and burster-folder station 11. A computer generated forms feeder 12 feeds continuous form control documents 13 having code marks 14 thereon to burster-folder 11 for separating and folding. The coded marks 14 on the control documents 13 are sensed by control scanner 15. Thereafter, serially arranged feeder stations 10, 9, 8, 7 and 6 sequentially feed the necessary documents onto the transport deck 16 at each station as the control document 13 arrives at the respective station to form a precisely collated stack of documents which is transported to the envelope feeder/insert station 5. Preferably, the transport deck 16 includes a ramp feed so that the control document always remains on top of the stack of advancing documents. The collated stack of documents is inserted into an envelope at envelope feeder/insert station 5. The necessary postage is provided and the envelope is sealed downstream from the envelope station.

Figure 2:
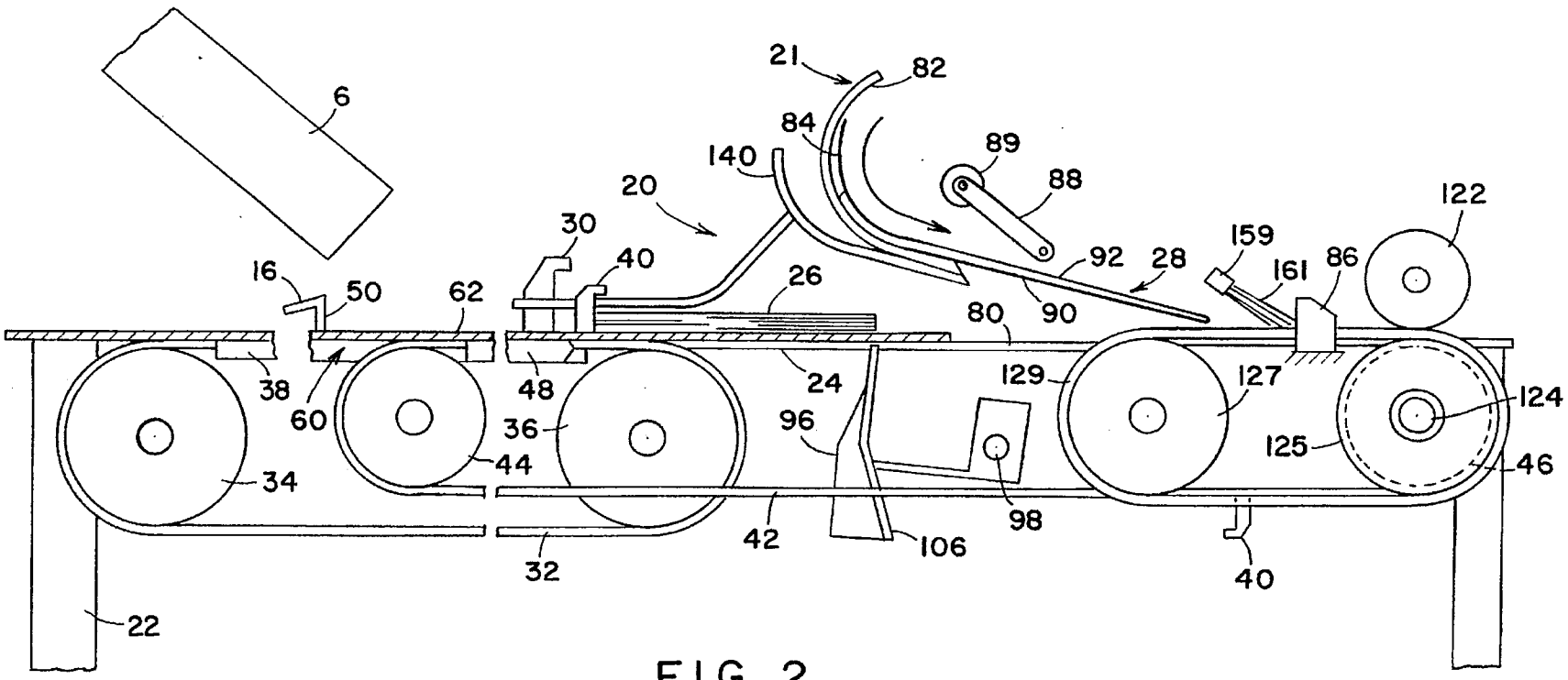
FIG. 2 is a side, elevational view of envelope stuffing apparatus in accordance with the instant invention.
Figure 3:
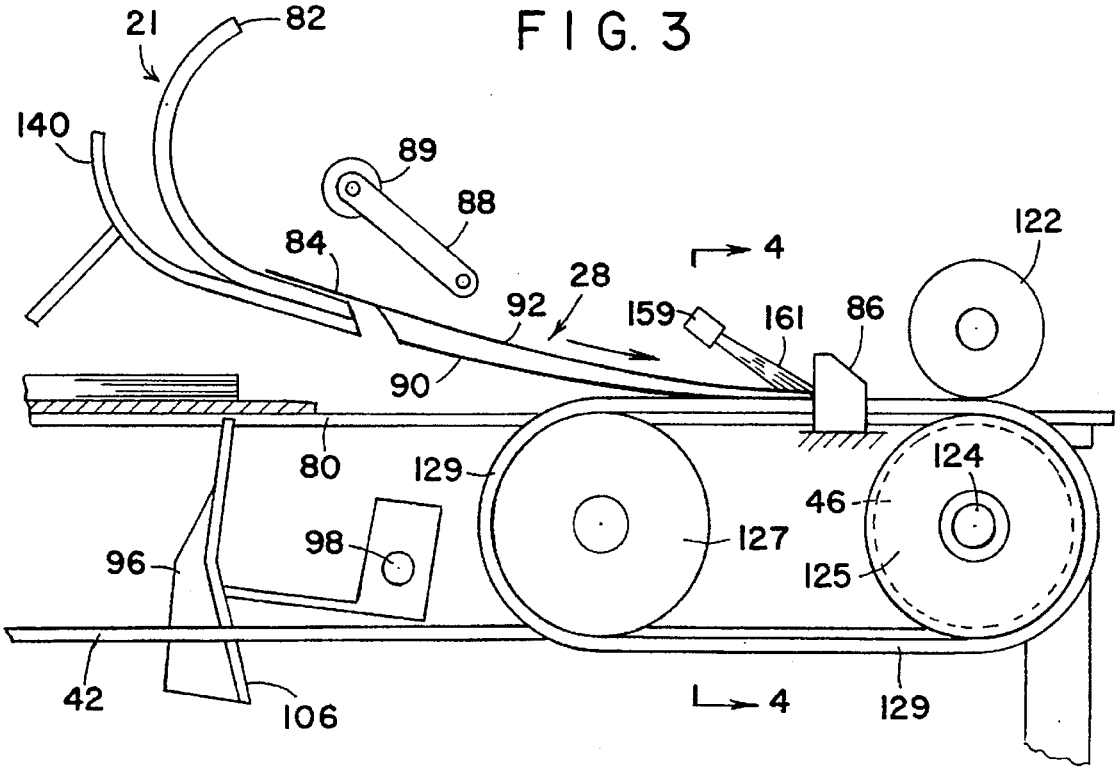
FIG. 3 is an enlarged, side, elevational view of the envelope insertion station with an envelope shown as just having been stopped.
Figure 4:
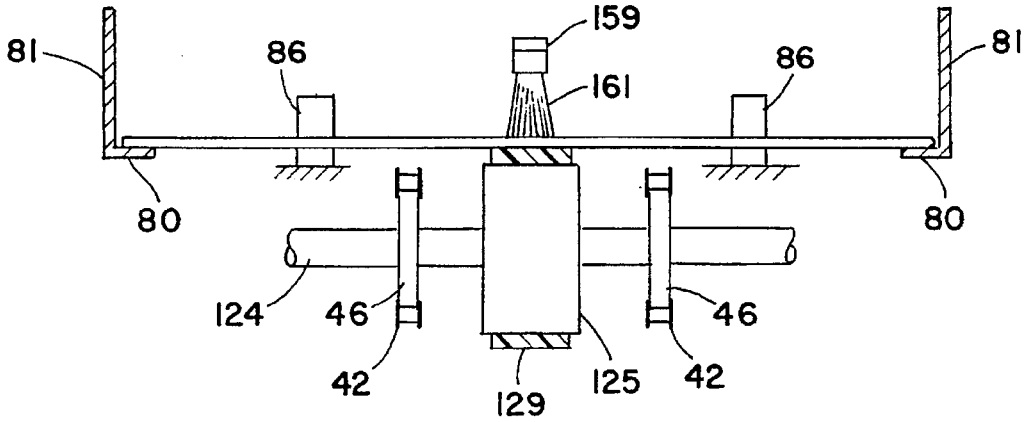
FIG. 4 is a sectional view taken on the plane indicated by the line 4—4 in FIG. 3.
Figure 5:
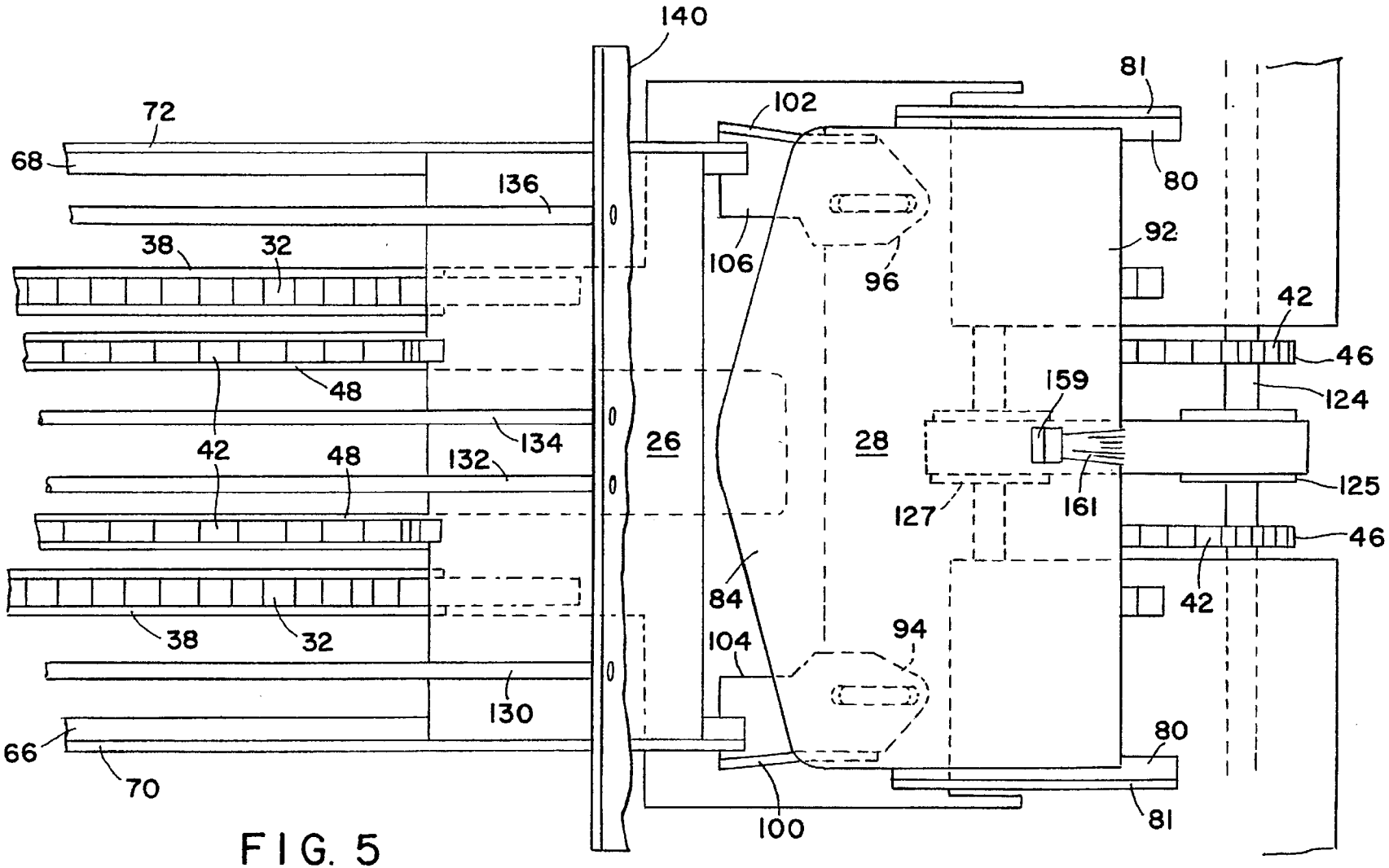
FIG. 5 is a top, plan view of the apparatus seen in FIG. 2.

Referring now to FIGS. 2 and 5, there is an insert station 20 shown. The insert station 20 comprises an envelope feeder 21 (shown only in part) and an envelope stuffing apparatus. The envelope stuffing apparatus comprises conventional framework 22 for supporting various components of the apparatus 20 including a deck support 24.

There are two pairs of pushers, each pair operating in parallel for delivering enclosure 26 to envelope 28. Each of the larger pair of pushers 30 is attached to one of a pair of endless chain drives 32 which are mounted on pairs of sprockets 34 and 36. Sprockets 34 are located upstream of the envelope stuffing apparatus. Sprockets 36 are located adjacent the insert area. The upper reach of each chain 32 is housed in a channel 38 for positioning and stabilizing the movement of pushers 30. In operation, pushers 30 transport enclosures 26 from the upstream feed stations of the inserter machine, for example, from the feeder 6 in FIG. 1, to the insert station 20 at a suitable speed, depending on the speed of the machine. For example, at 7200 cycles, the pushers 30 are moving 27 inches per second.

Downstream from the last enclosure feeder 6, a smaller pair of pushers 40 are each fixed to one of a pair of endless chain drives 42 each of which chain drives is mounted on sprockets 44 and 46. Sprockets 46 are the drive sprockets which are driven at a speed whereby pushers 40 have a linear speed, for example, of approximately one and one half (1.5) the linear speed of pushers 30. The upper reaches of chains 42 are housed in channels 48 for positioning and stabilizing the movement of pushers 40.

Sprockets 44 are positioned adjacent the last enclosure feeder 6 and the change in deck level 16 at 50. Beginning at the deck level change 50, the enclosures are transported on an insert station deck 60 consisting of center deck plate 62 and the bottom members 66 and 68 of side guides 70 and 72 respectively (see FIG. 5).

The distance between longitudinally spaced pushers 40 on each chain drive 42 is a function of the distance between every two longitudinally spaced pushers 30 on chain drive 32 and the speed differential desired comparing the speed of pushers 40 to the speed of pushers 30. In the preferred embodiment of the present invention, the distance between longitudinally spaced pushers 30 is 27 inches. Therefore, for a desired speed differential of approximately 1.5, the distance between longitudinally spaced pushers 40 is 42 inches (or approximately 1.5 times 27 inches). In the preferred embodiment of the present invention, there are two pushers 40 on each of chain drives 42. In operation, the pushers 40 overtake pushers 30 in the delivery of the enclosures to the insert station shortly after pushers 30 transport the enclosures past deck level change 50. It will be understood that any suitable drive mechanism for pushers, for example, a belt drive, could also be used to drive pushers 40.

Envelopes 28 are fed from the envelope feeder 21 (shown in part) to envelope deck 80. In the preferred embodiment of the present invention, envelope deck 80 comprises two adjustable side guides 81 each with a bottom member acting as the deck 80. An example of an envelope feeder which can be used in conjunction with the present invention is described in U.S. Pat. No. 4,775,140 issued to Dean H. Foster on Oct. 4, 1988 and assigned to the assignee of the present invention. There is a ledge 82 on which the envelope flap 84 is supported during insertion of the enclosures. As the envelope is fed, a pair of stops 86 are used to stop and register the envelope 28. There are a plurality of depressor fingers 88, each including a roller 89, which apply pressure to the envelope flap 84 during the insertion of the enclosures. The depressor fingers 88 provide stability to the envelope 28 during throat opening and insertion of enclosures. In the preferred embodiment of the present invention at least two fingers 88 are used. When an envelope 28 is fed, depressor fingers 88 are in a raised position as seen in FIG. 2.

There are a pair of throat openers 94 and 96 which open the envelope by separating the bottom side 90 of envelope 28 from the upper side 92. The throat openers 94 and 96 pivot about point 98 from a retracted position seen in FIG. 2 below the deck to a position (not shown) whereby the throat openers 94 and 96 become a continuation of deck 60 for guiding the enclosures into envelope 28. The throat openers 94 and 96 each include an outside, upright member which acts as a continuation of side guides 70 and 72 respectively, thereby preventing the enclosure from crashing into the side edges of envelope 28. Adding side guide members 100 and 102 to throat openers 94 and 96 respectively prevents any skewing of the inserts or crashing of the inserts into the side edges of envelope 28.

The downstream end of side guides 70 and 72 overlap, respectively, with the upstream portion of throat openers 94 and 96 which are downwardly angled at 104 and 106 so that side guide 70 ends above the angled portion 104 and side guide 72 ends above angled portion 106. In this manner, throat openers 94 and 96 perform the dual task of opening envelope 28 and continuing the side guide into the envelope.

In addition to opening envelope 28, throat openers 94 and 96 act as side guides for the collation 26 and also act as ramps for avoiding a collision between the collation 26 and the side edges of envelope 28.

In the preferred embodiment of the present invention, the movement of stops 86, depressor fingers 88 and throat openers 94 and 96 is controlled respectively by three conventional cams on a shaft (not shown) under deck support 24. The cams are suitable for sequentially raising stops 86, lowering fingers 88 and raising throat openers 94 and 96 as envelope 28 is fed.

As enclosures 26 are about to be inserted into envelope 28, the outside edges of the enclosures, which are being transported on the bottom members 66 and 68 of side guides 70 and 72, are pushed onto throat openers 94 and 96, and the center of the enclosures is raised slightly to ensure that the enclosures do not hit the bottom side 90 of envelope 28. Because of the lip of deck plate 62, the center of the enclosures misses the bottom edge of envelope 28 and hits the lower side of flap 84. This greatly reduces the chance of a poor insertion in this area.

It will be appreciated by those skilled in the art that the side guides 70, 72 and 81, depressor fingers 88 and throat openers 94 and 96 can be laterally positioned to handle different sized enclosures and envelopes.

The previously discussed sprockets 46 are mounted on a drive shaft 124 on which a drive pulley 125 is fixedly secured. Downstream of the drive pulley 125 is an idler pulley 127, and a high friction, flat take-away belt 129 is trained over the pulleys 125 and 127. A spring-loaded idler roller 122 located above the pulley 125 cooperates with the flat belt 129 to yank the envelope 28 from the pushers 40 before the pushers 40 begin to follow the perimeter of the sprockets 46. The drive pulley 125 has a diameter larger than sprockets 46 such that the linear speed of the envelope in the grasp of the belt 129 and the roller 122 is faster than the linear speed of the pushers 40. Situated just upstream of the stops 86 is a brush mount 159 for an adjustable, moving brush 161 which provides a light, normal force with the take-away belt 129. The continuously running belt 129 provides bounce back resistance against the stops 86 for the envelope 28, and the orientation of the bristles of the brush 161, i.e. the ends of the brush 161 are located below and downstream of the brush mount 159, provides additional bounce back resistance.

The speed differential between pushers 30 and 40 may cause enclosures 26 to rise off the deck as pushers 40 take over the advancement of enclosures 26. There are guide bars 130, 132, 134 and 136 which act to insure that the enclosures remain below the upper member lip of each pusher 40. The guide bars also act in conjunction with ledge 140 to ensure suitable clearance as the top of the enclosure stack enters the envelope 28. Guide bars 130, 132, 134 and 136 are suitably mounted upstream in a frame member (not shown) and downstream to ledge 140. Ledges 140 and 82 include two slot openings corresponding to the path of pushers 40 to ensure ledges 140 and 82 do not interfere with pushers 40.

There is a sensor switch (not shown) associated with each throat opener. The sensors operate to detect when an envelope is not present or has not been opened for insertion.

One cycle of the operation of the insert station 5 will now be described in detail. Initially, the entire collation 26 is pushed by the pushers 30 towards the insertion area. At the same time, an envelope 28 is fed down to the envelope deck 80. The envelope stops 86 are in a raised position and the depressor fingers 88 are in a down position for holding the envelope flap 84. The throat openers 94 and 96 have pivoted up and have opened the envelope 28, which is ready to receive the collation 26. Next, the pusher 40, which are traveling 1.5 times faster than the pushers 30, take over the delivery of the collation 26 from the pushers 30 and move the collation 26 away from the pushers 30 before the pushers 30 begin to go under the deck 80.

Then, the pushers 30 are under the deck and the pushers 40 are inserting the collation 26 into the envelope 28. The stops 86 have begun to descend below the deck 80, while the throat openers 94 and 96 and the depressor fingers 88 remain in their engaged positions.

Next, the stops 86 descend below the deck 80, and the collation 26 is completely within the envelope 28. The pushers 40 begin to advance the stuffed envelope toward the idler roller 122. The depressor fingers 88 continue to apply pressure on the flap 84, but the rollers 89 on the fingers 88 allow the pushers 40 to push the envelope flap 84 out from under the fingers 88, which apply pressure suitable to ensure that the insertion is completed.

The collation 26 then settles down into the envelope 28 and the stops 86 are completely down. The pushers 40 continue to push the stuffed envelope toward the idler roller 122. The throat openers 94 and 96 and the fingers 88 pivot back to their disengaged position.

From the foregoing description, it can be appreciated that the continuously running, flat belt 129 is able to continuously urge the envelope 28 against the stops 86, thereby preventing the envelope 28 from bouncing back off the stops 86. The brush 161 further ensure that there will be no bounce back of the envelope 28 off the stops 86. It should be noted that the brush mount 159 is adjustable and can be moved upstream or downstream depending on the size of the envelope 28 being processed. The stops 86 are likewise adjustable, so that the stops 86 and the brush 161 are always adjacent each other regardless of where they are positioned.

It should be understood by those skilled in the art that various modifications may be made in the present invention without departing from the spirit and scope thereof, as described in the specification and defined in the appended claims.

What is claimed is:

1. Apparatus for inserting sheet materials into an envelope, comprising:

a deck for supporting an envelope having a flap and sheet material to be inserted into said envelope, said deck having an upstream and a downstream end;

an inserting station located at the downstream end of said deck;

a retractable stop extending through said deck at said inserting station;

an upstream and a downstream pulley located substantially below said deck at said inserting station, said upstream pulley located upstream of said stop and said downstream pulley located downstream of said stop;

a belt trained over said upstream and downstream pulleys for continuously urging said envelope against said stop;

means to continuously drive said belt;

means for feeding envelopes onto said deck against said stop;

means for inserting said sheet material into said envelope when said envelope is resting against said stop; and a brush situated upstream of said stop and above said belt for providing a normal force against said belt and to assure no bounce back of said envelope off said stop.

2. The apparatus of claim 1, wherein said brush includes a top and a bottom, and the bottom of said brush is located downstream of the top of said brush.

3. The apparatus of claim 2, wherein said inserting means comprises a chain drive and a pusher secured to said chain drive for moving said sheet material into said envelope.

4. The apparatus of claim 3, wherein said envelope feeding means includes a ledge for supporting the flap of said envelope during insertion of the sheet material into the envelope.

5. The apparatus of claim 4, wherein said envelope feeding means additionally includes a depressor finger for applying pressure to the envelope during insertion of the sheet material into the envelope.

* * * * *